US007223214B2

(12) United States Patent
Chen

(10) Patent No.: US 7,223,214 B2
(45) Date of Patent: May 29, 2007

(54) ADJUSTABLE DUMBBELL

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 679 days.

(21) Appl. No.: 10/621,150

(22) Filed: Jul. 15, 2003

(65) Prior Publication Data

US 2004/0005969 A1 Jan. 8, 2004

Related U.S. Application Data

(63) Continuation-in-part of application No. 09/867,509, filed on May 31, 2001, now Pat. No. 6,656,093.

(51) Int. Cl.
*A63B 21/072* (2006.01)
*A63B 21/075* (2006.01)

(52) U.S. Cl. ..... 482/107; 482/108

(58) Field of Classification Search ..... 482/106–109, 482/93–94, 908

See application file for complete search history.

(56) References Cited

U.S. PATENT DOCUMENTS 4,566,690 A 1/1986 Schook ..... 272/123
5,344,375 A * 9/1994 Cooper ..... 482/106
5,407,413 A 4/1995 Kupferman ..... 482/106
5,484,367 A * 1/1996 Martinez ..... 482/107
5,839,997 A 11/1998 Roth et al. ..... 482/107
6,656,093 B2 * 12/2003 Chen ..... 482/108
6,669,606 B2 * 12/2003 Krull ..... 482/98

FOREIGN PATENT DOCUMENTS

SU 1618430 A1 * 1/1999

* cited by examiner

*Primary Examiner*—Jerome Donnelly
*Assistant Examiner*—Fenn C. Mathew
(74) *Attorney, Agent, or Firm*—Charles E. Baxley

(57) ABSTRACT

An adjustable dumbbell device includes a handle, a number of weights each having a channel to slidably receive an end portion of the handle, and a latch slidably engaged onto the end portion of the handle and engageable into the channels of a selected number of the weights, to secure the selected number of the weights to the end portion of the handle. A securing device may be used for securing the latch to the end portion of the handle, and includes one or more beams attached to the end portion of the handle, and a spring biasing catch may catch the latch to the beams or the end portion of the handle.

15 Claims, 5 Drawing Sheets

ADJUSTABLE DUMBBELL

The present invention is a continuation-in part of U.S. patent application Ser. No. 09/867,509, filed on May 31, 2001, now U.S. Pat. No. 6,656,093.

BACKGROUND OF THE INVENTION

1. Field of the Invention

The present invention relates to an adjustable dumbbell, and more particularly to an adjustable dumbbell assembly having an easily and quickly adjustable structure.

2. Description of the Prior Art

Various kinds of typical adjustable dumbbells have been developed. U.S. Pat. No. 4,566,690 to Schook, and U.S. Pat. No. 5,407,413 to Kupferman disclose two of the typical dumbbells each including one or more weight rings that may be selectively or adjustably secured together for adjusting the weight of the dumbbells.

In U.S. Pat. No. 4,566,690 to Schook, the weight rings each includes an outer thread for threading with the inner threads of the other weight rings and for securing the weight rings together. It takes time to thread the weight rings together.

In U.S. Pat. No. 5,407,413 to Kupferman, the weight rings are engaged on a core or a rod and each includes a number of posts for engaging into the holes of the other weight rings. It is also required to secure the weight rings together one by one. In addition, the weight rings may be rotated and disengaged from each other while in use.

U.S. Pat. No. 5,839,997 to Roth et al. discloses another typical adjustable dumbbell including a number of weight rings to be selectively or adjustably secured together with a shaft that is required to be rotated relative to the weight rings or the like. However, the weight rings or weight members may not be solidly secured to the shaft while in use.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including an easily and quickly adjustable structure.

In accordance with one aspect of the invention, there is provided an adjustable dumbbell assembly comprising a handle including a first end, a plurality of weights each including a channel formed therein to slidably and selectively receive the first end of the handle, a latch slidably engaged onto the first end of the handle, and slidably engageable into the channels of a selected number of the weights respectively, and a securing device for securing the latch to the first end of the handle, and to secure the selected number of the weights to the first end of the handle.

Each of the weights includes a groove formed therein and communicating with the channel thereof, to slidably receive the first end of the handle. The grooves of the weights include a width smaller than that of the channel to slidably receive the first end of the handle, the latch includes a width greater than that of the grooves of the weights.

The securing device includes at least one beam attached to the first end of the handle, and a catching device for catching the latch to the beam of the first end of the handle. The securing device includes a block secured to the first end of the handle, and the beam is secured to the block and thus secured to the first end of the handle.

The block includes at least one cavity formed therein to receive an end portion of the beam. The handle includes a plate extended from the first end thereof, the block includes a space formed therein to receive the plate. The handle includes an extension extended from the first end thereof and parallel to the beam, the latch is slidably engaged onto the extension of the handle.

The securing device includes a cap secured to the first end of the handle, and the cap includes at least one cavity formed therein to receive an end portion of the beam. The beam includes a plurality of projections extended from the beam and engaged with the weights, to position the weights to the beam, and to prevent the weights from moving along the beam.

The beam includes a passage formed therein, the securing device includes a rod secured to the latch and slidably engaged in the passage of the beam. The catching device includes a catch slidably engaged onto the rod for engaging with the beam, to catch and secure the latch to the beam. A spring biasing device may bias the catch to engage with the beam, and to catch and secure the latch to the beam.

The first end of the handle includes a passage formed therein to slidably receive the latch therein. The handle includes a second end, and a plurality of second weights may be selectively secured to the second end of the handle.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
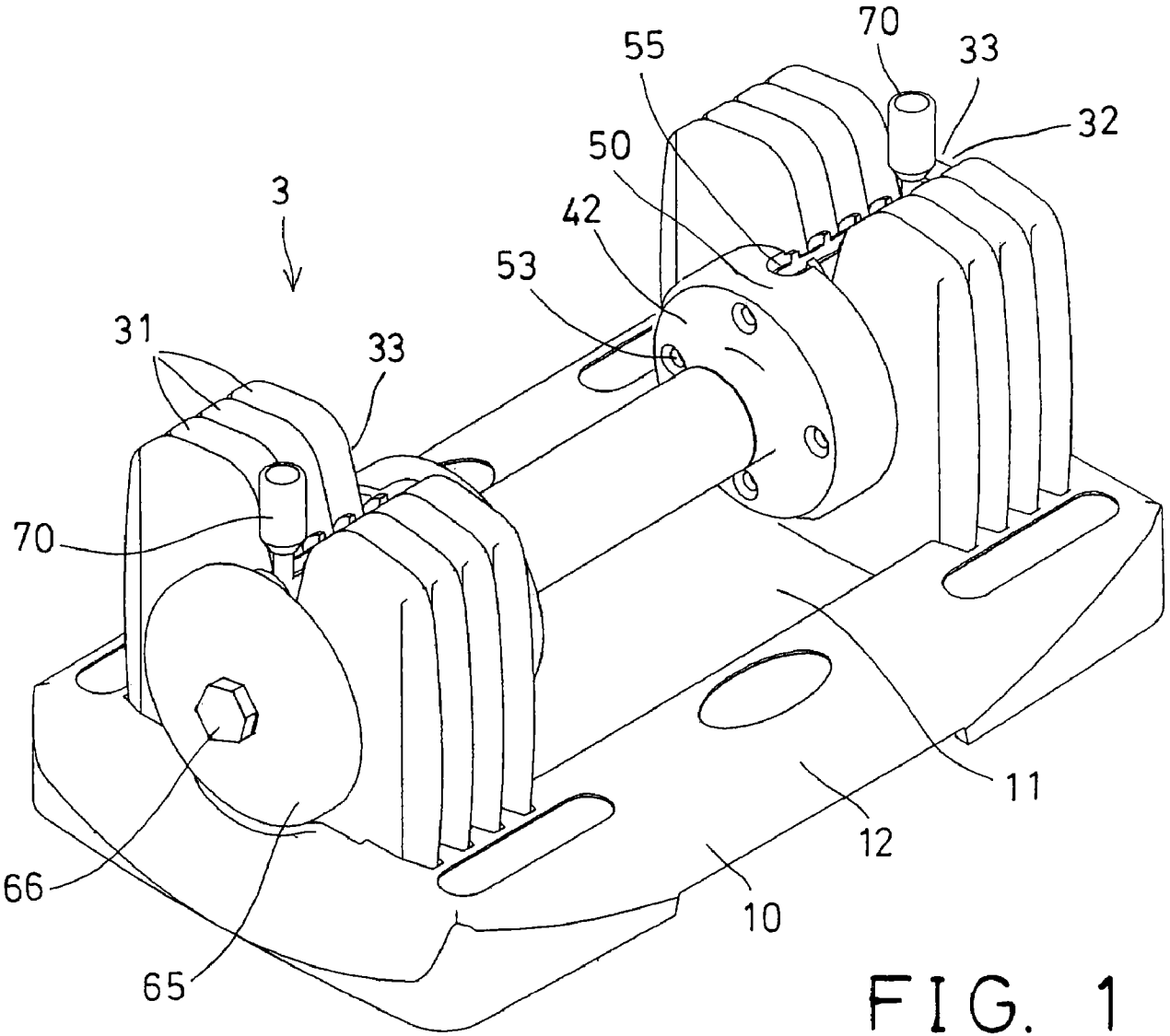
FIG. 1 is a perspective view of an adjustable dumbbell assembly in accordance with the present invention.
Figure 2:
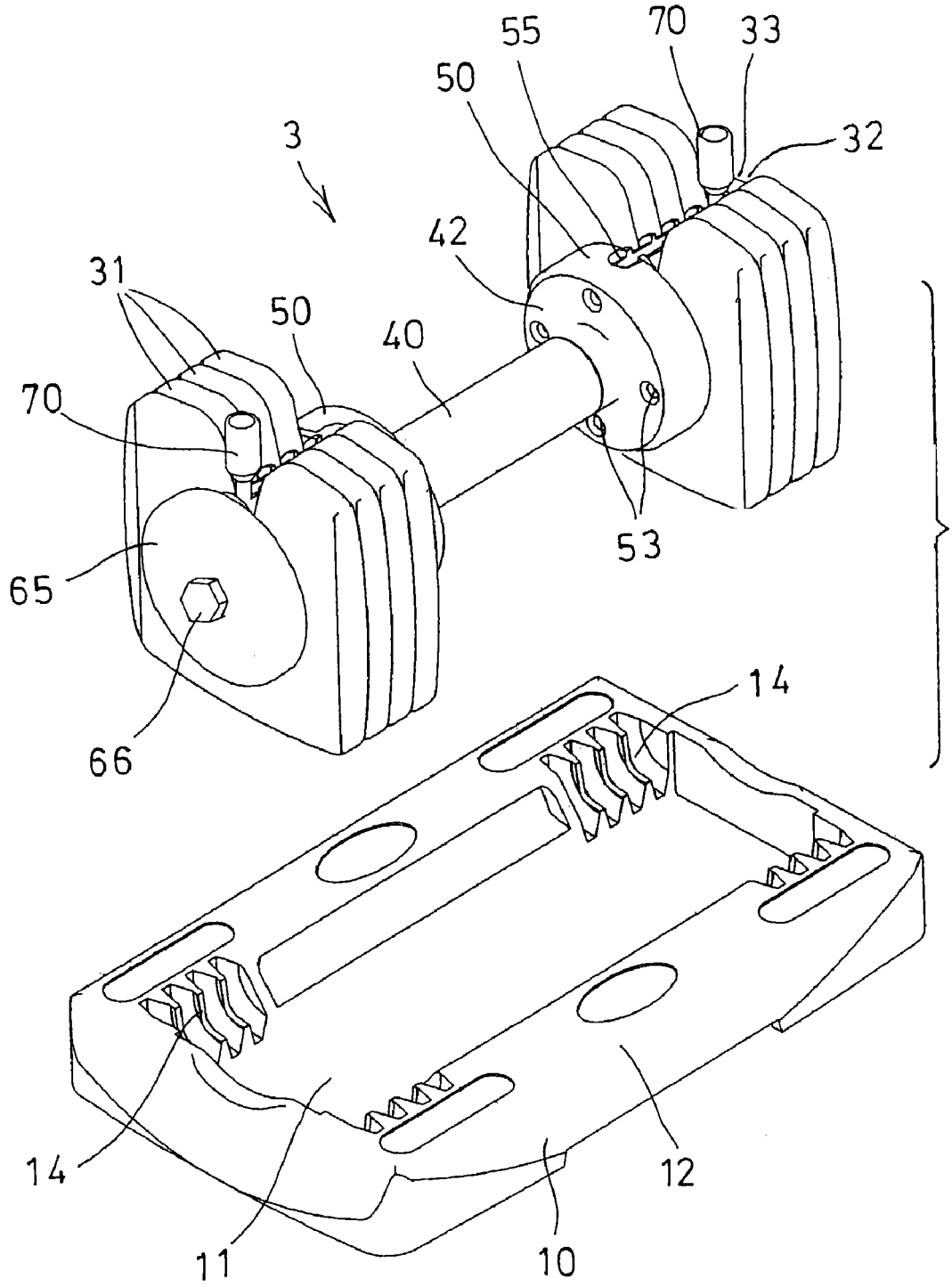
FIG. 2 is a partial exploded view of the adjustable dumbbell assembly.
Figure 3:
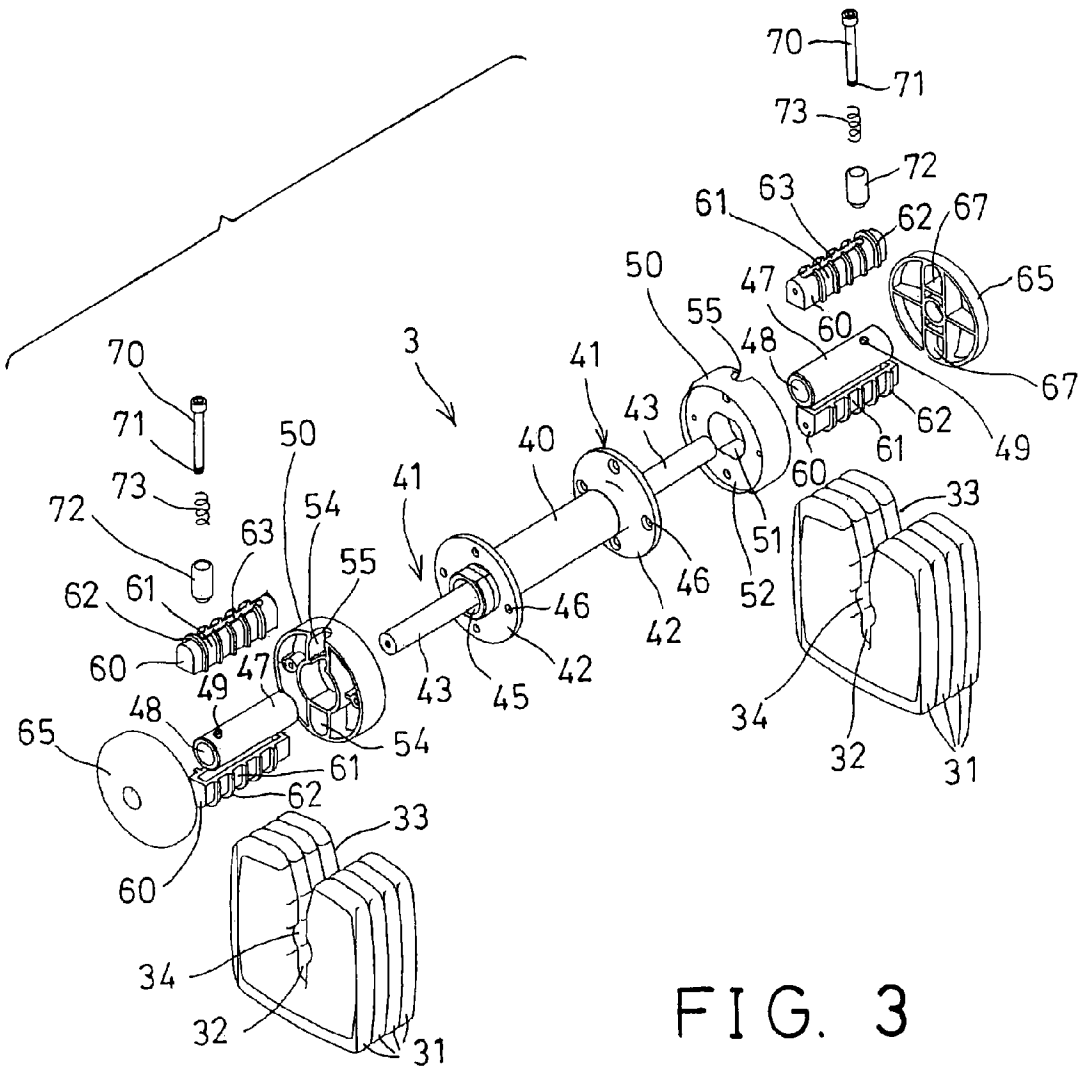
FIG. 3 is another partial exploded view of the adjustable dumbbell assembly.
Figure 4:
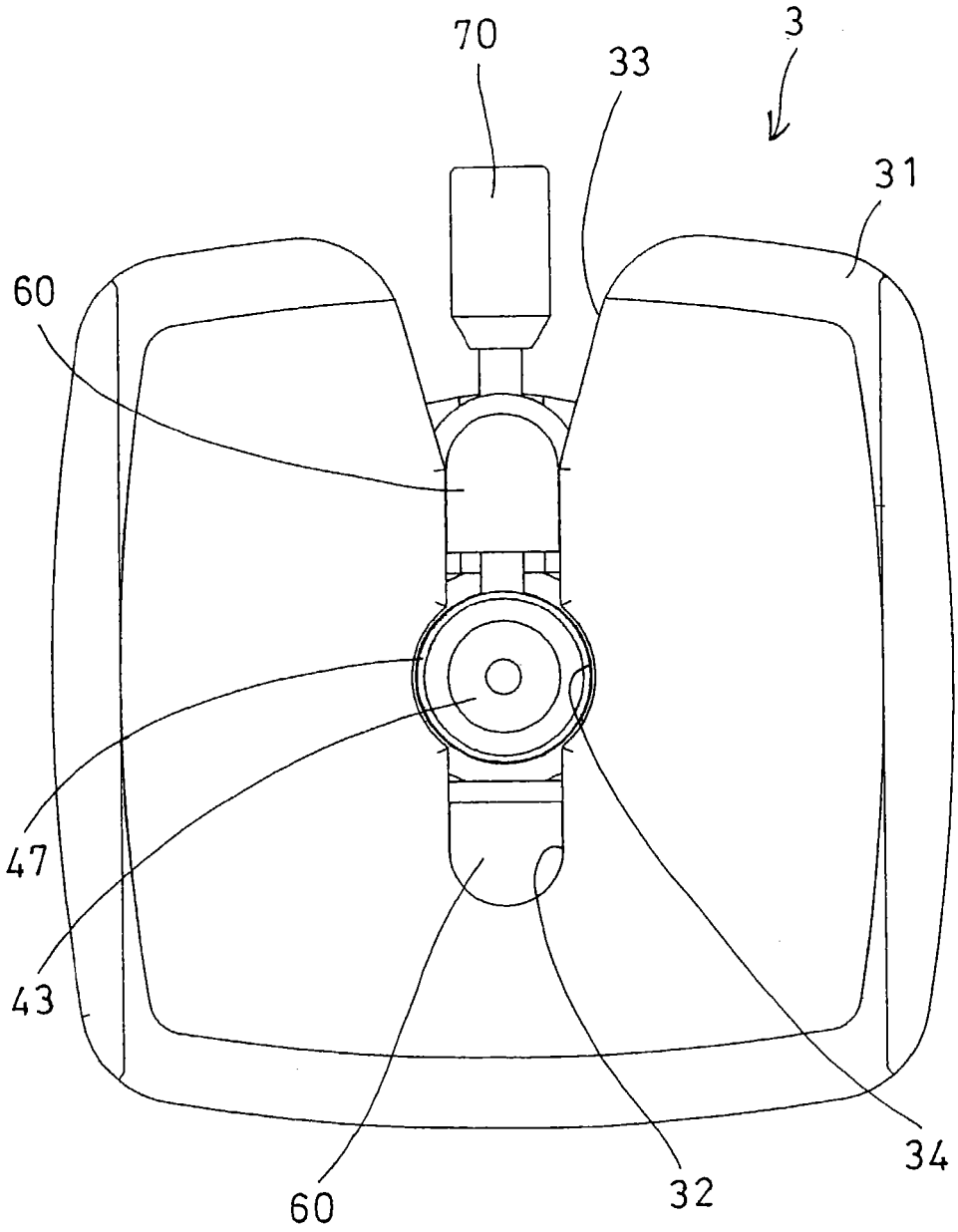
FIG. 4 is an end view of the adjustable dumbbell assembly.

Referring to the drawings, and initially to FIGS. 1–5, an adjustable dumbbell assembly in accordance with the present invention comprises a base 10 including a recess 11 formed therein and defined by two side bulges 12, for receiving or supporting a dumbbell device 3 therein. Each of the bulges 12 of the base 10 includes a number of socket depressions 14 formed therein.

The dumbbell device 3 includes a number of weights 31 each having a lower portion engageable or receivable in the socket depressions 14 of the base 10, for allowing the weights 31 to be stably and erectly supported on the base 10. However, the lower portions of the weights 31 may also be arranged to be erectly supported on ground without the base 10.

Each of the weights 31 includes a groove, such as a vertical groove 32 formed therein and having an open top 33, and includes a lateral channel 34 formed therein and communicating with or intersecting with the vertical groove 32 thereof. The lateral channel 34 of the weight 31 includes a width or an inner diameter greater than the width of the groove 32 of the weight 31.

A rod or handle 40 includes two end portions 41 each having a plate 42 extended radially and outwardly therefrom, and each having an extension 43 extended laterally and outwardly therefrom, and each having an annular or peripheral passage 45 formed therein and provided around the extension 43 of the handle 40. Each of the plates 42 includes one or more orifices 46 formed therein.

Two cylindrical latches 47 are slidably engaged onto the extensions 43 of the handle 40 respectively, and engageable into the peripheral passage 45 of the handle 40 respectively. Each of the cylindrical latches 47 includes a bore 48 formed therein to slidably receive the extensions 43 of the handle 40 respectively, and includes a screw hole 49 formed therein.

Two blocks 50 each includes a bore 51 formed therein to slidably receive the extensions 43 of the handle 40 respectively, and each includes a space 52 formed therein to receive the respective plate 42. One or more fasteners 53 may be engaged through the orifices 46 of the plates 42 and threaded to the blocks 50, to detachably secure the blocks 50 to the plates 42.

Each of the blocks 50 includes one or more, such as two cavities 54 formed therein, and a notch 55 formed therein and communicating with one of the cavities 54 thereof. It is preferable that the cavities 54 of the blocks 50 are oppositely formed in the respective blocks 50, and preferably provided or positioned on the opposite sides of the bore 51 thereof.

One or more, such as two beams 60 are parallel to the extensions 43 of the handle 40 and each includes one end received and/or secured in the respective cavities 54 of each of the blocks 50, and each includes one or more slots 61 formed therein and defined by one or more projections 62, and each includes a passage 63 communicating with the slots 61 thereof respectively.

Two caps 65 are secured to the free ends of the extensions 43 of the handle 40 with such as fasteners 66 respectively, and each has one or more, such as two cavities 67 formed therein, to receive the other ends of the beams 60 respectively, and to solidly secure the beams 60 between the caps 65 and the blocks 50, and thus to solidly secure the beams 60 to the end portions 41 of the handle 40.

It is to be noted that the beams 60 may also be formed integral with the end portions 41 of the handle 40, as those disclosed in the co-pending U.S. patent application Ser. No. 09/867,509, filed on May 31, 2001, which may thus be taken as a reference for the present invention. The beams 60 may also be formed integral with the extensions 43 of the handle 40 respectively.

The extensions 43 of the handle 40 may thus be provided or extended between the beams 60, and preferably include an outer diameter or a width no greater than the width of the beams 60 respectively, such that the beams 60 and/or the extensions 43 of the handle 40 may be moved into or through the grooves 32 of the weights 31 respectively.

Figure 5:
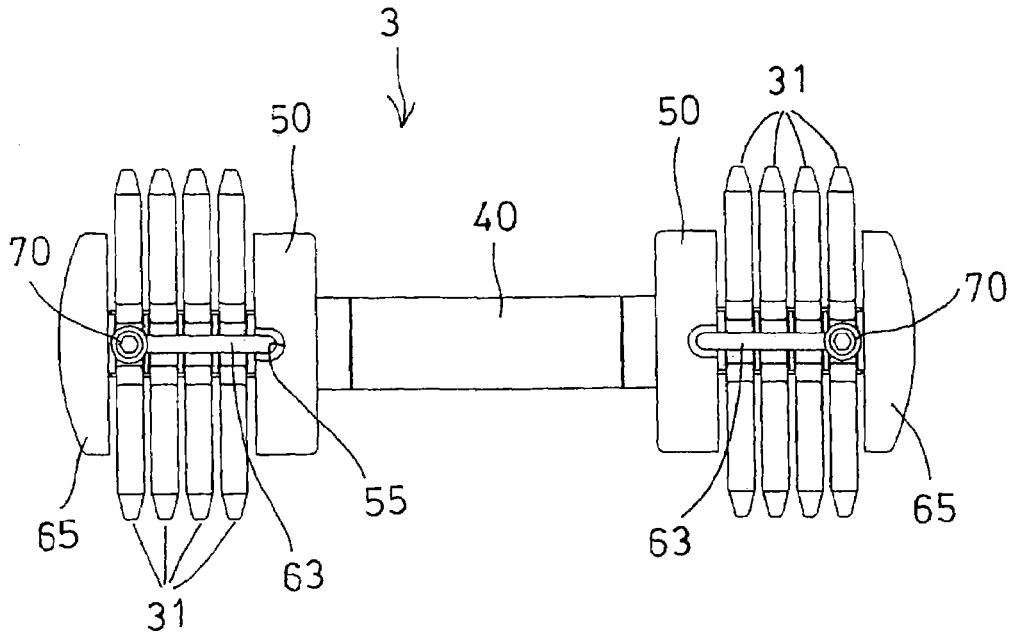
FIG. 5 is a top plan view of the adjustable dumbbell assembly.
Figure 6:
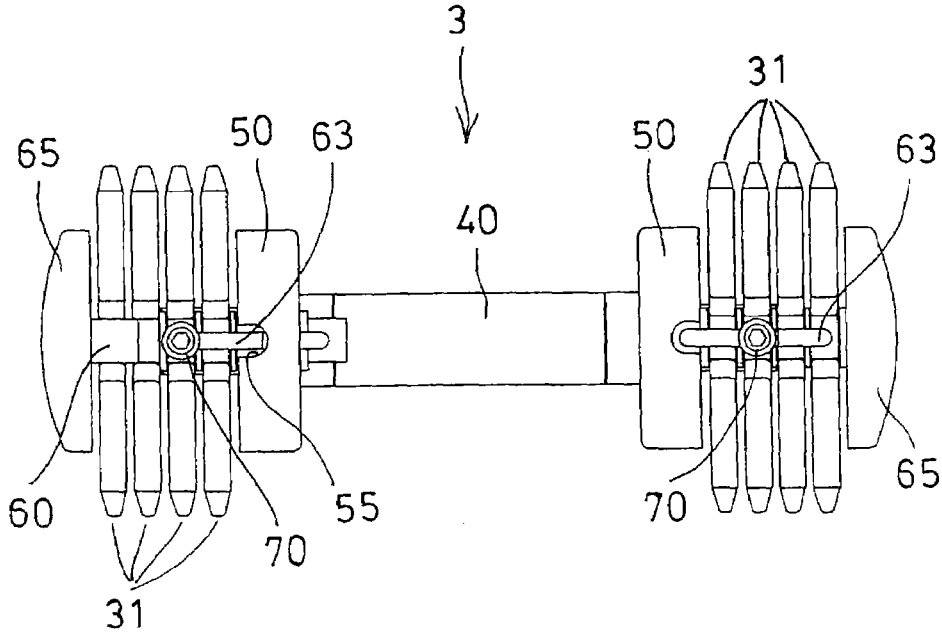
FIG. 6 is a top plan view similar to FIG. 5, illustrating the operation of the adjustable dumbbell assembly.

In operation, as shown in FIGS. 5 and 6, the beams 60 may be engaged into the grooves 32 of the weights 31 via the open top 33 of the weights 31 respectively. The projections 62 of the beams 60 are extended from the beams 60 and engaged between the weights 31, to position the weights 31 to the beams 60, and to prevent the weights 31 from moving laterally relative to the beams 60 and the handle 40.

The cylindrical latches 47 are slidably engaged onto the extensions 43 of the handle 40 respectively, and are slidably receivable in the lateral channel 34 of the weight 31 respectively, and include an outer diameter greater than the width of the grooves 32 of the weights 31, in order to selectively engage and latch the weights 31 to the beams 60 or the extensions 43 of the handle 40.

Two rods 70 are secured to the cylindrical latches 47 respectively, or each includes a threaded portion 71 threaded to the screw holes 49 of the cylindrical latches 47 respectively, and thus moved in concert with the cylindrical latches 47 respectively. Two catches 72 are slidably engaged onto the rods 70 respectively and biased to engage with the beams 60 by springs 73, for example.

The rods 70 are slidably engaged in the passage 63 of the beams 60 respectively, and may be moved along the beams 60 or the end portions 41 or the extensions 43 of the handles 40 respectively, in order to move the latches 47 along the end portions 41 of the handles 40 respectively, and so as to engage the latches 47 into the lateral channels 34 of the required number of weights 31.

For example, as shown in FIG. 5, the latches 47 have been engaged into the lateral channels 34 of all or four of the weights 31 respectively, such that all or four of the weights 31 may be latched or coupled to the end portions 41 or the extensions 43 of the handles 40 respectively. Similarly, only two of the weights 31 (FIG. 6) may be latched to each of the end portions 41 of the handles 40.

When or after the latches 47 have been engaged into the lateral channels 34 of the required number of weights 31, the catch 72 may be biased by the spring 73 to engage with the beam 60, and retained or positioned between the projections 62 of the beams 60 respectively, so as to solidly latch or secure the latches 47 and the required or selected number of weights 31 together.

As also shown in FIG. 6, the latches 47 have not been engaged into the lateral channels 34 of the two outer weights 31, such that the beams 60 may be moved out through the grooves 32 of the two outer weights 31 when the beams 60 and the handle 40 are lifted upwardly relative to the weights 31, and such that the number of the weights 31 may be selectively attached to the handle 50.

It is to be noted that the latches 47 are slidably engaged onto the extensions 43 of the handle 40 respectively, and may be easily and effectively moved along the extensions 43 of the handle 40 respectively with the rods 70 respectively, and thus to easily secure or latch the required or selected number of weights 31 to the end portions 41 or the extensions 43 of the handles 40 respectively.

The rods 70 may also be engaged into the notches 55 of the blocks 50 respectively, for allowing the latches 47 to be disengaged from the lateral channels 34 of all of the weights 31, and thus for allowing the handle 40 to be disengaged from all of the weights 31 when the handle 40 is lifted away from the weights 31, such that the users may also exercise with the handle 50 only.

Accordingly, the adjustable dumbbell assembly in accordance with the present invention includes an easily and quickly adjustable structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a handle including a first end, a plurality of weights each including a channel formed therein to slidably and selectively receive said first end of said handle, a tubular latch slidably engaged onto and around said first end of said handle, and slidably engageable into said channels of a selected number of said weights respectively, and means for securing said latch to said first end of said handle, and to secure the selected number of said weights to said first end of said handle.

2. The adjustable dumbbell as claimed in claim 1, wherein each of said weights includes a groove formed therein and communicating with said channel thereof to slidably receive said first end of said handle.

3. The adjustable dumbbell as claimed in claim 2, wherein said grooves of said weights include a width smaller than that of said channel to slidably receive said first end of said handle, said latch includes a width greater than that of said grooves of said weights.

4. The adjustable dumbbell as claimed in claim 1, wherein said securing means includes at least one beam attached to said first end of said handle, and means for catching said latch to said at least one beam of said first end of said handle.

5. The adjustable dumbbell as claimed in claim 4, wherein said securing means includes a block secured to said first end of said handle, and said at least one beam is secured to said block and thus secured to said first end of said handle.

6. The adjustable dumbbell as claimed in claim 5, wherein said block includes at least one cavity formed therein to receive an end portion of said at least one beam.

7. The adjustable dumbbell as claimed in claim 5, wherein said handle includes a plate extended from said first end thereof, said block includes a space formed therein to receive said plate.

8. The adjustable dumbbell as claimed in claim 4, wherein said handle includes an extension extended from said first end thereof and parallel to said at least one beam, said latch is slidably engaged onto said extension of said handle.

9. The adjustable dumbbell as claimed in claim 8, wherein said securing means includes a cap secured to said first end of said handle, and said cap includes at least one cavity formed therein to receive an end portion of said at least one beam.

10. The adjustable dumbbell as claimed in claim 4, wherein said at least one beam includes a plurality of projections extended from said at least one beam and engaged with said weights, to position said weights to said at least one beam, and to prevent said weights from moving along said at least one beam.

11. The adjustable dumbbell as claimed in claim 4, wherein said at least one beam includes a passage formed therein, said securing means includes a rod secured to said latch and slidably engaged in said passage of said at least one beam.

12. The adjustable dumbbell as claimed in claim 11, wherein said catching means includes a catch slidably engaged onto said rod for engaging with said at least one beam, to catch and secure said latch to said at least one beam.

13. The adjustable dumbbell as claimed in claim 12 further comprising means for biasing said catch to engage with said at least one beam, and to catch and secure said latch to said at least one beam.

14. The adjustable dumbbell as claimed in claim 1, wherein said first end of said handle includes a passage formed therein to slidably receive said latch therein.

15. The adjustable dumbbell as claimed in claim 1, wherein said handle includes a second end, and a plurality of second weights selectively secured to said second end of said handle.

* * * * *